US007155842B2

(12) United States Patent
Oliver Petri

(10) Patent No.: US 7,155,842 B2
(45) Date of Patent: Jan. 2, 2007

(54) MICROWAVE MIXER/DRYER REACTOR FOR INDUSTRIAL USE

(76) Inventor: Ralf Oliver Petri, Avda. Europa 42-Local A-Pozuelo de Alarcón, Madrid (ES) 28224

( * ) Notice: Subject to any disclaimer, the term of this patent is extended or adjusted under 35 U.S.C. 154(b) by 0 days.

(21) Appl. No.: 10/501,085

(22) PCT Filed: Jun. 28, 2002

(86) PCT No.: PCT/ES02/00321

§ 371 (c)(1),
(2), (4) Date: Jul. 9, 2004

(87) PCT Pub. No.: WO03/059500

PCT Pub. Date: Jul. 24, 2003

(65) Prior Publication Data

US 2005/0118077 A1 Jun. 2, 2005

(30) Foreign Application Priority Data

Jan. 16, 2002 (ES) ..... 200200080

(51) Int. Cl.
*H05B 6/74* (2006.01)

(52) U.S. Cl. ..... 34/259; 34/265; 219/748; 219/752; 219/756; 219/762

(58) Field of Classification Search ..... 34/245, 34/259, 265; 219/746–749, 752, 753, 756, 219/726, 762
See application file for complete search history.

(56) References Cited

U.S. PATENT DOCUMENTS 4,778,970 A * 10/1988 Klaila ..... 219/748
5,003,143 A * 3/1991 Marks et al. ..... 219/685
5,481,092 A * 1/1996 Westmeyer ..... 219/748
5,708,259 A * 1/1998 Shieh et al. ..... 219/762

FOREIGN PATENT DOCUMENTS

EP 0611937 A1 * 8/1994

* cited by examiner

*Primary Examiner*—Jiping Lu
(74) *Attorney, Agent, or Firm*—Defillo & Associates, Inc.; Evelyn A. Defillo

(57) ABSTRACT

The invention relates to a microwave mixer/dryer/reactor for industrial use. The inventive machine has a three-fold purpose, namely to: a) mix solid products with solids, solids with liquids and solids with very viscous fluids; b) dry aforementioned products; and c) initiate reaction between said products by means of suitable microwave discharge from a generator which is specially connected to the shaft of the machine. Said machine can be used to perform one or two of said functions or all the functions together.

2 Claims, 3 Drawing Sheets

MICROWAVE MIXER/DRYER REACTOR FOR INDUSTRIAL USE

OBJECT OF THE INVENTION

Figure 1:
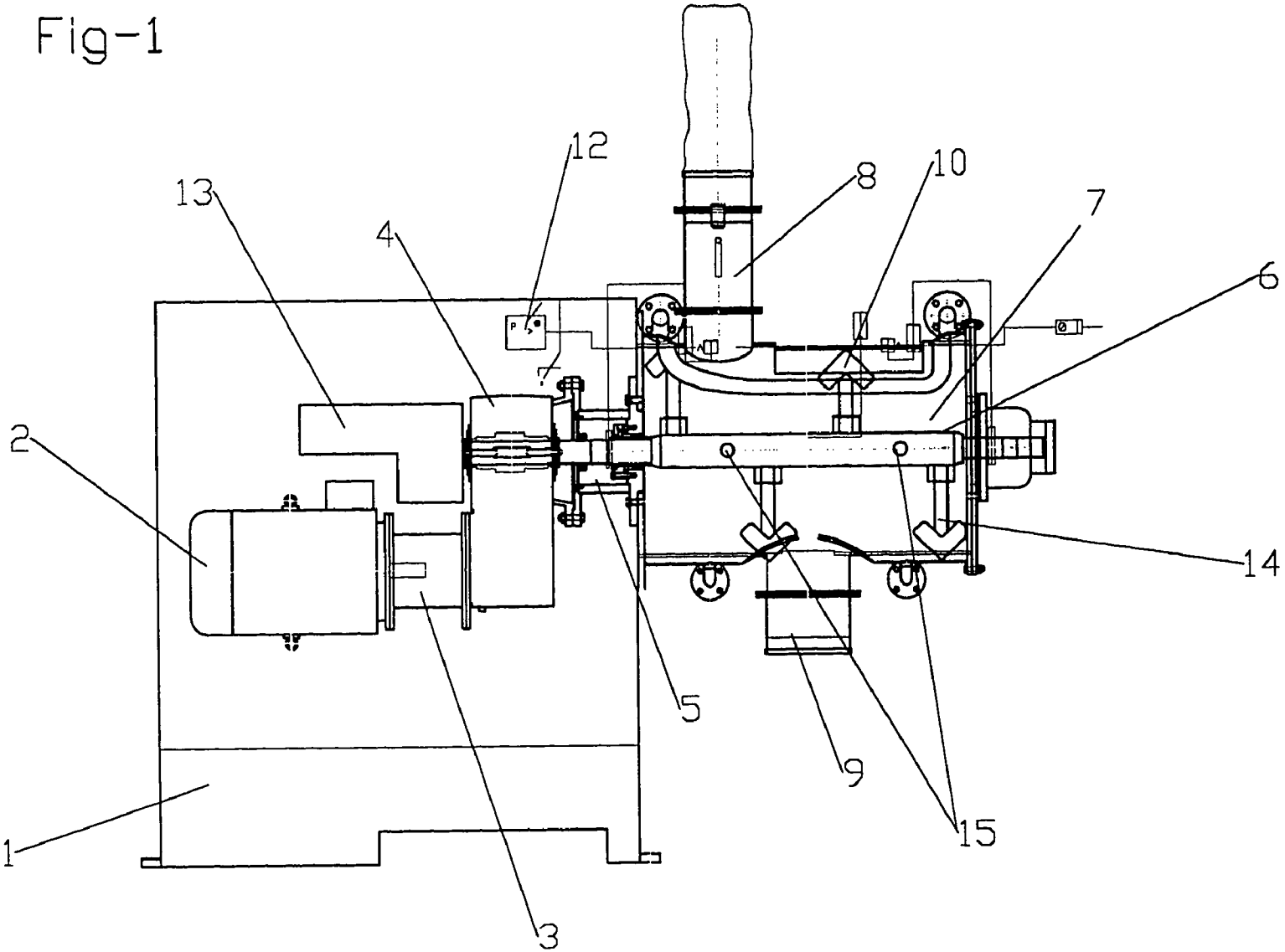

Microwave mixer-dryer-reactor for industrial use, designed for mixing all types of products, solids with solids, solids with liquids and solids with very tacky fluids, also obtaining through product mixing the subsequent drying, as well as the start of a reaction when it is thus required by a massive discharge of microwaves proceeding from a generator especially attached to the spindle of the machine, being possible to use just one of the functions or any combination of them.

BACKGROUND OF THE INVENTION

In the current industry the machines and process necessary to carry out any of the three processes mentioned are available; thus, there are a great variety of both horizontal and vertical mixers, generally composed of a cylindrically shaped chamber in which the products to be mixed are deposited. In the centre of said chamber a spindle is introduced, which may have blades attached, or which may have the shape of an endless screw, among other different constructive arrangements, depending on the characteristics of the product to be mixed. Said spindle is attached onto a motor, which upon turning makes the spindle mix the product. Said cylindrical chamber often includes two areas or a double sleeve, one in which the products to be mixed are deposited, and another one, outside the first, through which a hot or cold liquid is sent, depending on whether one wishes to warm or cool the products to be mixed.

As examples of this type of mixers, the following are available:

- European Patent Application n° 90107482. Dryer-mixer for producing and elaborating dry, humid, pastes, and fluid products.
- European Patent Application n° 93120513. Dryer mixer
- European Patent Application n° 94108192. Mixer-granulator-dryer-container.

The drying process is based on eliminating water or other liquids carried by the products. In order to eliminate them different mechanical processes have been developed, through warm air, etc. as well as electrical ones, for example be way of microwaves or radio frequency. The following patents are known:

- European Patent Application n° 96914119. Crystalline substance drying facility.
- European Patent Application n° 96923192. Aggressive drying by convection in a tapered screw mixer/dryer.
- European Patent Application n° 8303667. Microwave treatment mechanism for eliminating dampness from articles.

The third process, or that of starting the reaction, is obtained by controlling the temperature of the mixture through controlling the power of the microwaves. In the case of a double chamber mixer dryer, it is carried out by sending more or less liquid through the second chamber, thus warming the mixture to the necessary temperature for its reaction. In the case of a microwave dryer the reaction is started by adjusting the power and frequency of the microwaves thus managing to increase the temperature for its reaction and intensifying the interaction of the microwaves in the material; the action of the reactants is influenced by the microwave emission frequency, said frequency being variable within all of the margin of microwaves.

As can be appreciated in the existing systems, the three processes that are the object of the present invention are effectuated independently, there being no machine that can carry out the mixing, microwave drying and starting of the chemical reactions together in one single continuous or discontinuous process, the unification of the three processes in one being what makes this invention innovative.

DESCRIPTION OF THE INVENTION

The present invention relates to a machine whose purpose is to unify in a single production process the processes that until now have been carried out separately, which are product mixing, drying by way of a microwave generator and the start of a reaction when the product thus requires, obtaining in this way production cost reduction by decreasing product manipulation, increasing their quality due to improved mixing, avoiding contamination by carrying out the whole process in a single machine, reducing cleaning product costs and labour and also avoiding in this way environmental pollution, enabling the three processes to be carried out continuously or discontinuously.

A machine has been built that is provided with all of the mechanisms of conventional mixers, adding all of the elements necessary to effectuate drying and starting the reaction due to the incorporation of a microwave generator and to the modifications effectuated in the mixing spindle, on which mixing blades are attached, in order to conduct the microwaves that are generated. In addition, said machine is provided with all of the security systems needed to avoid possible accidents by microwave dispersion.

The machine of invention has a bed or machine support on which the main motor is arranged, whose power will depend on the mass and physical properties of the product to be mixed; a clutch is coupled onto said motor, and this in turn is coupled to a reducer also designed for the purpose it is to carry out. Between the reducer and the mixing spindle an elastic apparatus is attached, thus composing all of these parts the motor and traction group for the mixing spindle.

Coupled to said bed and centred with the mixing spindle is the mixing drum, of horizontal cylindrical shape, with double sleeve and made of steel of different qualities depending on the requirements of the process. The products to be mixed are loaded through a loading mouth located on the upper part of the mixing drum, and a liquid can be sent through the double sleeve to cool or warm the mixture. In addition, this mixing drum is provided with a discharge mouth for discharging the product on its lower part, with an inspection door, located adequately on the drum, with a system for adding liquids to the mixture when needed, and with an airing mouth for airing the mixture.

All of the components coupled to the mixing drum, such as the loading and discharge mouths, are provided with locks or valves with a security system which, in case one of them should be opened during the process, makes the microwave generator stop immediately, automatically interrupting the process and preventing the dispersion of microwaves in every case.

One of the main components of the machine that is the object of the present invention is the mixing spindle, coupled on one side of the reducer box and on the other rested on the end of the mixing drum. This is the element in which all of the maximum efforts are generated since by way of the mixing blades that are attached to it must mix all of the products within the mixing drum. In order to ensure effective mixing, one or several mixing intensifiers are attached, made up or blades mounted on a spindle that is moved by a motor through an elastic assembly, and which are mounted on the sides of the drum, said blades staying inside said drum and in contact with the product.

In order for the microwaves to enter into contact with the mixture and to warm it, thus eliminating water or solvents or making the mixture react, the mixing spindle has been designed so that it is hollow inside and includes holes that radially pass through to its outer surface, of different sizes, arranged in a regular distribution along the spindle and with circular or rectangular shapes. This hollow spindle is open at one of its ends in order to allow the entry of the microwaves and closed at the opposite end in order to prevent said microwaves from dispersing unduly.

A microwave generating apparatus mounted on the open end of the mixing spindle is responsible for sending the microwaves through said spindle, which come out through the holes arranged on it, thus entering into contact with the mixing product.

The working sequence is identical for both single load machines and for continuous process machines and is always made up of the following steps.

- Loading of the material through the different loading mouths, (solids or liquids) in the appropriate proportions or times depending on the products to be mixed.
- Mixing of the loaded product by way of the mixing blades attached to the mixing spindle; said mixing is carried out by making the mixing spindle turn, the turning speed of the same being adjustable in order to thus obtain a homogeneous mixture.
- Once the mixed products are dried or are made to react upon the microwaves entering into contact with them; these are produced in a microwave generator situated outside of the mixing drum and are sent to the product through the inside of the mixing spindle and coming out of the mixing drum through the radial holes bored in said mixing spindle.
- Once all of these processes are completed, the product is discharged through the discharge mouth.

This procedure can be carried out continuously or discontinuously, the first option being used when the material enters continuously without stopping into the mixer, thus producing the mixture, drying, and chemical reaction during the passage of the material through the machine and discharging the material continuously also at the end of the reaction, through the discharge mouth. In a discontinuous manner, the material is loaded into the machine at once, the drying, chemical reaction, and discharging of all of the material being carried out also in a single process.

DETAILED DESCRIPTION OF THE DRAWINGS

In order to provide an improved understanding of the present invention, a preferred embodiment is described below of the object of the present invention, based on the attached figures.

FIG. 1: General view of the mixer and its components.

Figure 2:
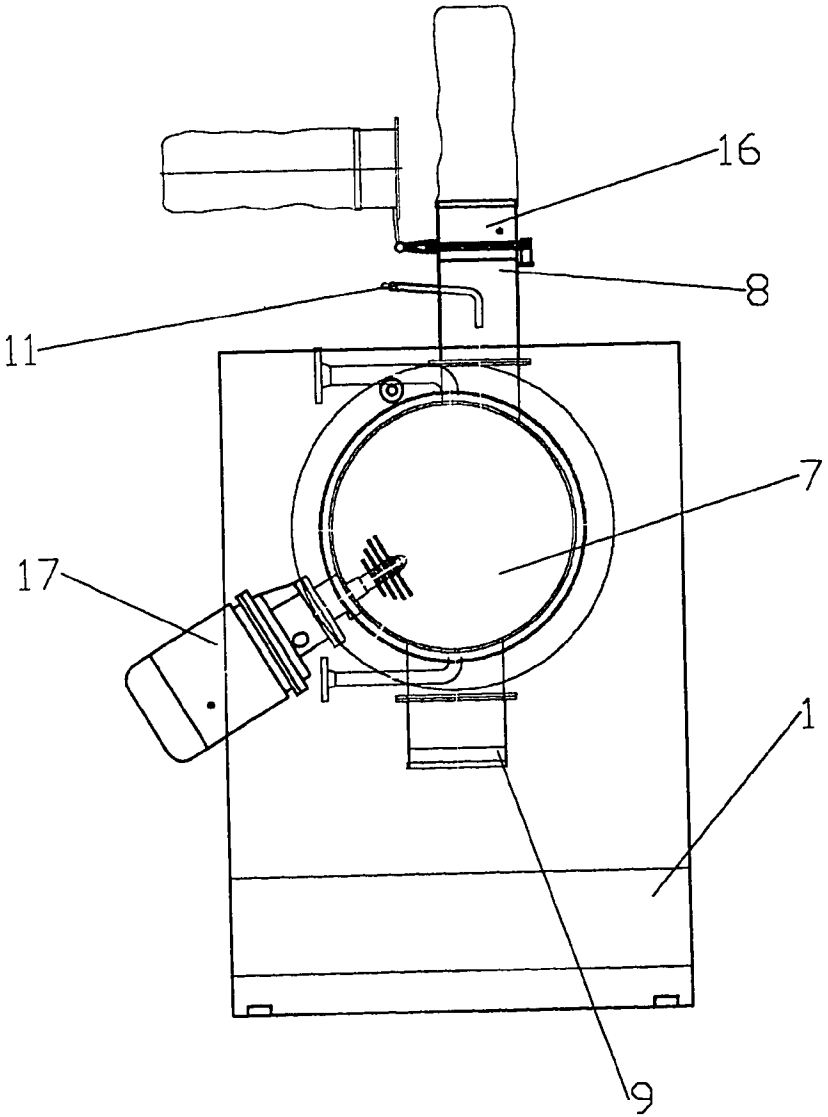

FIG. 2: View of the locations of the loading mouths and of the intensifiers.

Figure 3:
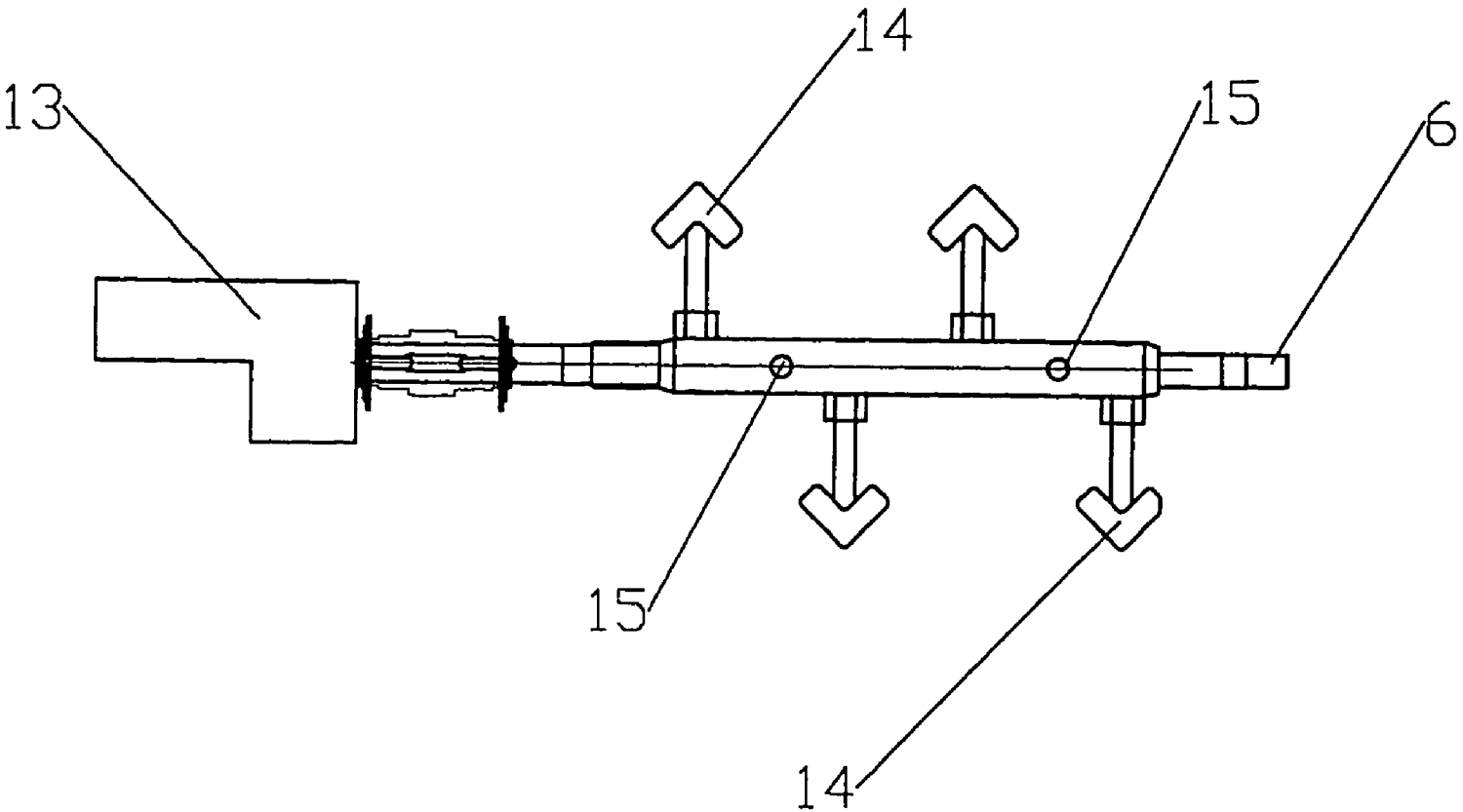

FIG. 3: View of the main spindle and microwave outlets.

PREFERRED EMBODIMENT OF THE INVENTION

The machine that is the object of the present invention unifies the three basic processes of a microwave mixer dryer reactor, which are: mixing several products, warming and drying of the product resulting from the mixture, as well as making it react, and its subsequent discharging, for which a machine has been developed which, although in its basic features it can be considered conventional, includes within it a microwave generator for warming and later drying the product, a completely innovative system in this type of machinery.

Thus, the machine of the present invention is composed of four main parts: the bed, the mixing drum, the mixing spindle and the microwave generator.

On the bed (1), the mixer dryer mechanism is located, serving said support bed and basis of the rest of the machine, and on it the main electrical motor is mounted (2), which a clutch has been coupled to (3) and to it, a reducer (4); between the reducer and the mixing spindle (6) an elastic assembly (5) is mounted, thus being defined the motor and traction group of the mixing spindle. All of these components, as the rest of the machine, are sized for the amount of material to be mixed and the physical properties of the product.

Coupled to said bed (1) and centred to the mixing spindle (6), the mixing drum (7) is located, having a horizontal cylindrical shape and double sleeve, and built of steel; the products to be mixed are loaded in the central part of the mixing drum through a loading mouth (8) located on its upper part. This mixing drum (7) is also provided with a product discharge mouth (9) on its lower part, with an inspection door, with a liquid adding system (11) for the mixture and with an airing mouth 16) for airing the mixture. All of the components coupled onto the mixing drum (7) such as the mouths for loading (8) and discharge (9), are provided with locks or valves with a security system (12) which, in case of accidental opening of one of the locks, causes an immediate stopping of the microwave generator, thus interrupting the whole process.

The third component of the machine which is the object of the present invention is the mixing spindle (6), coupled on one side to the reducer box (4) by way of a connection (5) and on the other side, rested on the end of the mixing drum (7); it is the component in which the maximum efforts are made since by way of the mixing blades (14) that are attached to it, and the intensifiers (17), it must mix all of the products inside the mixing drum. It is also the conduct of the microwaves from the generator (13) to the product, said microwaves entering into contact with the product after having passed through the holes (15) bored in the mixing spindle (6). This hollow spindle is open at one of its ends in order to allow microwaves to enter, and closed at the opposite end in order to prevent said microwaves from dispersing unduly.

At the open end of the mixing spindle (6) a microwave generator (13) is assembled. In order for the microwaves to enter into contact with the mixture the mixing spindle (6) has been designed in such a way that it is hollow inside and on whose outer surface pinholes (15) have been made passing through it radially, said holes (15) being of circular shape and said holes (15) being distributed regularly along said mixing spindle (6), so that the microwaves generated by the microwave generator (13) coupled onto one of the ends of said mixing spindle (6) reach the mixing product, thus also eliminating water or solvents.

What is claimed is:

1. Microwave mixer-dryer-reactor for industrial use, characterised in that it is composed of:

- a horizontal cylindrically shaped, double-sleeved mixing drum (7), which is provided with a loading mouth (8) located on the upper part of said mixing drum (7) where the products to be mixed are introduced, with a discharge mouth (9) for discharging the product, with an inspection door (10) for the product located on the upper part of the mixing drum (7), with a system (11) for adding liquids to the mixture, with intensifiers (17) arranged and inserted radially on said drum (7), and with an airing mouth (16) for airing the mixtures, the loading and discharge mouths (8), (9) having locks or valves with a security system (12) which, in case of accidental opening of said locks or valves, stops the mixer-dryer-reactor and interrupts the process;

a mixing spindle (6) coupled on one side of the reducer (4) through a connection (5) and rested on the other side on the mixing drum (7), said mixing spindle (6) having mixing blades (14) attached, being said mixing spindle (6) in the shape of a hollow tube, closed at one end and open at the other end, through the inside of which microwaves are sent and distributed from the generator (13) to the product, which are introduced through the open end of said mixing spindle (6) and enter into contact with said product through the radial holes (15) bored in the mixing spindle (6);

a support bed (1) for the mixer-dryer-reactor in which the mechanisms, traction motors and connections of said mixer-dryer-reactor are located;

a microwave generator apparatus (13) provided on the open end of the mixing spindle (6) which sends microwaves to the product through the inside of the hollow of said mixing spindle (6).

2. Microwave mixer-dryer-reactor for industrial use according to claim 1, characterised in that the mixing spindle (6) is provided with some pin holes (15) bored into the outer surface of said mixing spindle (6), said holes (15) having a circular or rectangular shape and said holes (15) being distributed along the mixing spindle (6), so that the microwaves generated by the microwave generator (13) coupled on the open end of said mixing spindle (6) reach the product through said holes (15) of said mixing spindle (6).

* * * * *